US011559175B2

(12) United States Patent
Wright

(10) Patent No.: US 11,559,175 B2
(45) Date of Patent: Jan. 24, 2023

(54) FULL BODY DRYER

(71) Applicant: Capujene Wright, Lumberton, NC (US)

(72) Inventor: Capujene Wright, Lumberton, NC (US)

( * ) Notice: Subject to any disclaimer, the term of this patent is extended or adjusted under 35 U.S.C. 154(b) by 834 days.

(21) Appl. No.: 16/539,175

(22) Filed: Aug. 13, 2019

(65) Prior Publication Data

US 2020/0046178 A1 Feb. 13, 2020

Related U.S. Application Data

(60) Provisional application No. 62/718,121, filed on Aug. 13, 2018.

(51) Int. Cl.

| | |
|---|---|
| ***A47K 10/48*** | (2006.01) |
| ***F24H 3/04*** | (2022.01) |
| ***A47B 67/00*** | (2006.01) |
| ***A47K 10/04*** | (2006.01) |

(52) U.S. Cl.

CPC ..... *A47K 10/48* (2013.01); *A47B 67/005* (2013.01); *A47K 10/04* (2013.01); *F24H 3/0405* (2013.01); *F24H 3/0417* (2013.01)

(58) Field of Classification Search

None

See application file for complete search history.

(56) References Cited

U.S. PATENT DOCUMENTS 3,128,161 A * 4/1964 Hudon ..... A47K 10/48 34/233
4,136,464 A * 1/1979 Hay ..... A47L 23/20 34/104
4,871,900 A * 10/1989 Hickman ..... A47K 10/48 4/600
4,961,272 A * 10/1990 Lee ..... A47K 10/48 34/239
5,007,182 A * 4/1991 Fishman ..... A47K 10/48 34/523
5,099,587 A * 3/1992 Jarosch ..... A47K 10/48 392/371
5,103,577 A * 4/1992 Michaels ..... A47K 10/48 34/91
5,222,308 A * 6/1993 Barker ..... A47L 23/205 34/239
5,251,066 A * 10/1993 Appelbaum ..... A47G 1/02 359/509
5,287,636 A * 2/1994 Lafleur ..... F26B 21/006 34/239
5,640,781 A * 6/1997 Carson ..... A45D 20/16 132/229
5,873,179 A * 2/1999 Gregory ..... A47K 10/48 34/91
5,930,912 A 8/1999 Carder (Continued)

*Primary Examiner* — Thor S Campbell
(74) *Attorney, Agent, or Firm* — Daniel Boudwin

(57) ABSTRACT

A full body dryer. The dryer includes a semi-circular base with a plurality of air tubes extending arcuately upward therefrom. The air tubes are extendable and retractable to adjust a height of the air tubes for use or for compact storage or transport. An upper end of each air tube of the plurality of air tubes includes an air vent to direct forced air toward a portion of an individual's body to dry the individual's body.

15 Claims, 4 Drawing Sheets

(56) References Cited

U.S. PATENT DOCUMENTS 6,085,436 A * 7/2000 Peet ..... D06F 59/04 34/106
6,148,539 A 11/2000 Hatfield et al.
6,349,484 B1 2/2002 Cohen
6,839,982 B1 * 1/2005 Hoover ..... A47K 10/48 392/382
6,962,005 B1 * 11/2005 Khosropour ..... A47K 10/48 34/235
D576,773 S * 9/2008 Beckett ..... D32/58
7,774,953 B1 * 8/2010 Duran ..... A47K 10/48 34/103
7,814,677 B2 * 10/2010 Brewer ..... A45D 20/12 392/382
8,112,899 B1 * 2/2012 Duckworth ..... A47K 10/48 34/526
9,585,498 B1 * 3/2017 Borden ..... A47B 49/00
10,292,457 B2 * 5/2019 Adkison ..... A43D 95/10
10,945,569 B1 * 3/2021 Varghese ..... F24H 9/2071
11,259,672 B1 * 3/2022 Henry ..... A47K 10/48
11,375,857 B2 * 7/2022 Gadde ..... A61L 2/10
2004/0213559 A1 * 10/2004 Schafer ..... A47K 10/48 392/382
2006/0021248 A1 2/2006 Symons
2009/0022485 A1 * 1/2009 Madden ..... A47K 10/48 392/382
2010/0050462 A1 * 3/2010 Attonito ..... A47K 10/48 34/201
2010/0064545 A1 * 3/2010 Pollack ..... A47K 10/48 34/275
2013/0025149 A1 1/2013 Farousi
2016/0100720 A1 * 4/2016 Holguin ..... A47K 10/48 34/90
2016/0169553 A1 * 6/2016 Wilder ..... F24H 3/0417 392/380
2018/0028010 A1 * 2/2018 Viedt ..... G01K 1/14
2018/0036200 A1 * 2/2018 Wilkinson ..... A61H 33/06
2018/0070722 A1 * 3/2018 Yang ..... F26B 21/001
2019/0219066 A1 * 7/2019 Ikeda ..... F04D 29/5806
2020/0046178 A1 * 2/2020 Wright ..... F24H 3/0417
2020/0085258 A1 * 3/2020 Yoo ..... A45D 20/12
2022/0015587 A1 * 1/2022 Gibbs ..... A47K 10/48

* cited by examiner

FULL BODY DRYER

CROSS REFERENCE TO RELATED APPLICATIONS

This application claims priority under 35 U.S.C. § 119(e) to U.S. Provisional Application No. 62/718,121 filed on Aug. 13, 2018. The above identified patent application is incorporated by reference herein in its entirety to provide continuity of disclosure.

BACKGROUND OF THE INVENTION

The present invention relates to a full body dryer for drying an individual's body.

Many individuals may have difficulty drying themselves after a bathing session, such as a bath or a shower. These individuals may be disabled or may be in a wheelchair, and may have trouble applying a towel or a hair dryer to become dry. In addition, existing larger dryers may not be able to be configured to be compact, which would allow for easier storage or transport.

Therefore, there is a need in the art for an improved full body dryer for drying an individual's body. The present invention addresses this unmet need.

Devices have been disclosed in the art that relate to body dryers. These include devices that have been patented and published in patent application publications. These devices are often either small and ineffective or large and difficult to store or transport. In view of the devices disclosed in the art, it is submitted that there is a need in the art for an improvement to existing full body dryers. In view of the present disclosure, it is submitted that the present invention substantially diverges in structural and functional elements from devices in the art, and substantially fulfills an unmet need.

SUMMARY OF THE INVENTION

In view of the disadvantages inherent in the known types of body dryers in the art, the present invention provides a new and improved full body dryer, wherein the same can be utilized for drying an individual's body.

It is therefore an object of the present invention to provide a full body dryer for drying an individual's body.

In one aspect, the invention provides a full body dryer, comprising a semi-circular base with a plurality of air tubes extending arcuately upward therefrom. Each air tube of the plurality of air tubes includes a base portion on a lower end thereof, and each base portion is connected to the semi-circular base. Each base portion includes a motor, a fan, and a heating element therein, the motor is operably connected to the fan, and the motor and the heating element are operably connected to a power source.

In another aspect, the invention provides a full body dryer, comprising a semi-circular base with a plurality of telescopic air tubes extending arcuately upward therefrom. Each air tube of the plurality of air tubes includes a base portion on a lower end thereof, and each base portion is pivotally connected to the semi-circular base. Each base portion includes a motor, a fan, and a heating element therein, such that the motor is operably connected to the fan, and the motor and the heating element are operably connected to a power source.

In yet another aspect, the invention provides a full body dryer, comprising a semi-circular base with a plurality of telescopic air tubes extending arcuately upward therefrom and a plurality of foot pedals extending laterally therefrom. Each air tube of the plurality of air tubes includes a base portion on a lower end thereof, such that each base portion is pivotally connected to the semi-circular base. Each base portion includes a motor, a fan, and a heating element therein, such that the motor is operably connected to the fan, and the motor and the heating element are operably connected to a power source. A first selection of foot pedals of the plurality of foot pedals is operably connected to the motor, and a second selection of foot pedals of the plurality of foot pedals is operably connected to the heating element.

In some embodiments, each air tube of the plurality of air tubes includes an air vent on an upper portion thereof, and each interior of each air vent is fluidly connected to an interior of the air tube thereunder.

In some embodiments, the semi-circular base includes a gap dimensioned to receive a wheelchair therethrough.

In some embodiments, the full body dryer further comprises one or more accessories attached thereto. In such embodiments, the one or more accessories may include one or more accessories selected from a group including, but not necessarily limited to, a lighted mirror, a shelf, a hook, and a combination thereof.

In some embodiments, the full body dryer further comprises a plurality of castor wheels disposed on an underside of the semi-circular base. In such embodiments, the plurality of castor wheels configures the full body dryer to be rolled on a surface.

Another object of the present invention is to provide a full body dryer that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
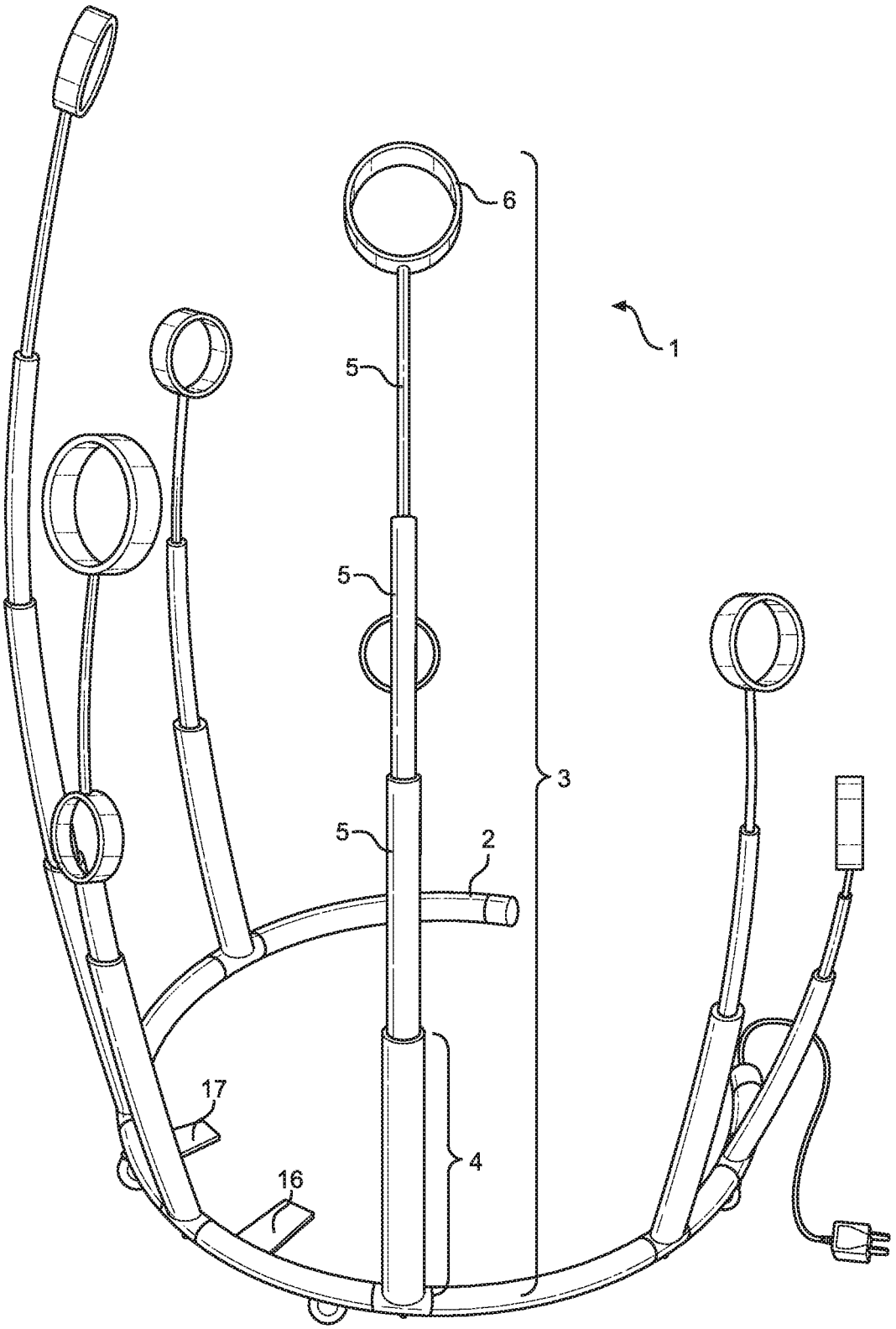
FIG. 1 depicts a perspective view of an exemplary full body dryer according to the present invention, with a plurality of air tubes in an extended configuration.

Reference is made herein to the attached drawings. Like reference numerals are used throughout the drawings to depict like or similar elements of the invention. The figures are intended for representative purposes only and should not be considered limiting in any respect.

Reference is now made to the drawings, which depict one or more exemplary embodiments of the invention.

Referring now to FIG. 1, there is depicted a perspective view of an exemplary full body dryer according to the present invention, with a plurality of air tubes in an extended configuration. A full body dryer 1 comprises a semi-circular base 2 with a plurality of air tubes extending arcuately upward therefrom. Each air tube 3 of the plurality of air tubes includes a base portion 4 on a lower end thereof, such that each base portion 4 is connected to the semi-circular base 2. As described elsewhere herein, each base portion 4 includes a motor, a fan, and a heating element therein. The motor is operably connected to the fan, and the motor and the heating element are operably connected to a power source.

In the shown embodiment, each air tube 3 of the plurality of air tubes includes an air vent 6 on an upper portion thereof. Each interior of each air vent 6 is fluidly connected to an interior of the air tube 3 thereunder, as described elsewhere herein. In the shown embodiment, the air tube 3 includes one or more intermediate portions 5, positioned above the base portion 4, configured to telescopically extend or retract to adjust a height of each air tube 3. An interior of the base portion 4 is fluidly connected to an interior of the semi-circular base 2, and the base portion 4 extends from the semi-circular base 2. Because the air tubes are telescopically adjustable, the body dryer 1 can be configured to dry a taller individual, an average-height individual, or a shorter individual, or may customized for drying an individual in a wheelchair or an individual in another seated or reclined position, according to need. In like manner, in the shown embodiment, the semi-circular base includes a gap dimensioned to receive a wheelchair therethrough, as described elsewhere herein. In addition, in the shown embodiment, the full body dryer 1 includes a plurality of foot pedals (16, 17) extending laterally from the base portion 4. In the shown embodiment, the left foot pedal 16 is operably connected to the motor(s) and fan(s) to control whether the motor(s) are on and the fan(s) are rotating, and the right foot pedal 17 is operably connected to the heating element(s) to control whether the heating element(s) are turned on to heat an air passing through the base portion 4. In this manner, an individual using the full body dryer 1 can operate the features while being dried.

Figure 2:
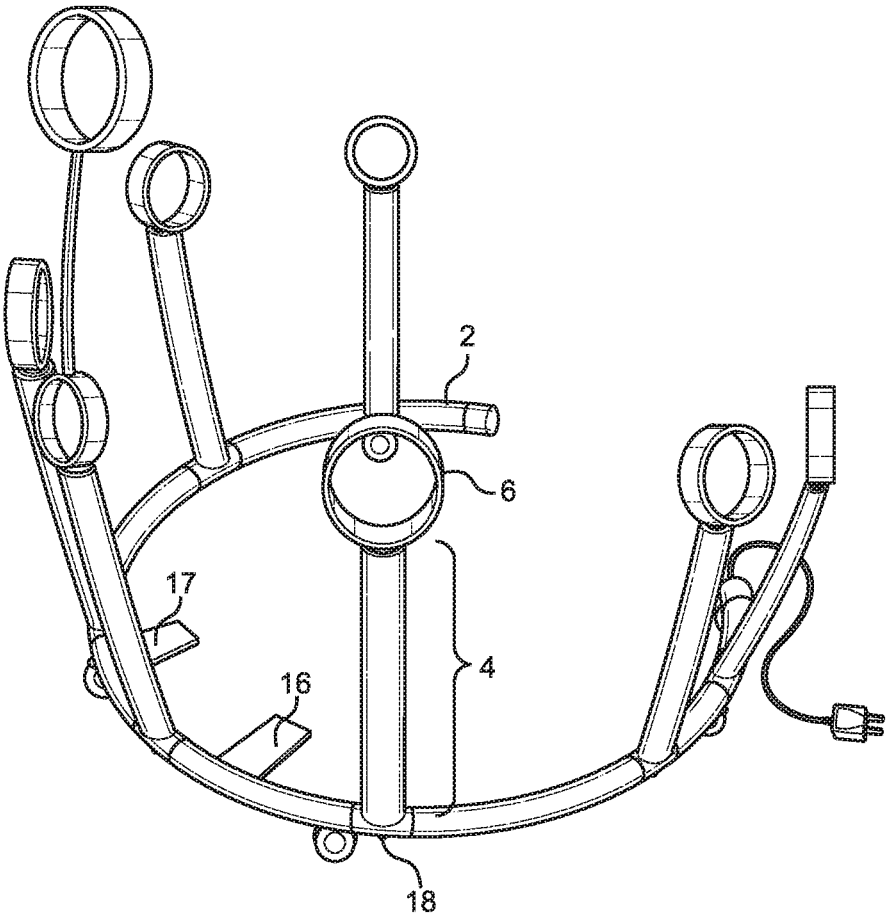
FIG. 2 depicts a perspective view of the exemplary full body dryer, with the plurality of air tubes in a retracted configuration.
Figure 3:
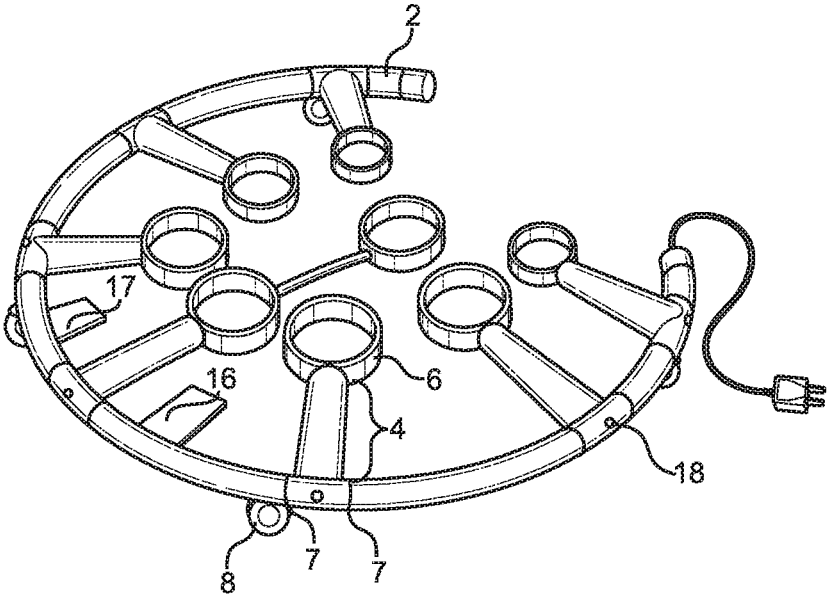
FIG. 3 depicts a perspective view of the exemplary full body dryer, with the plurality of air tubes in the retracted configuration and in a folded configuration.

Referring now to FIGS. 2 and 3, there are depicted a perspective view of the exemplary full body dryer, with the plurality of air tubes in a retracted configuration (FIG. 2) and a perspective view of the exemplary full body dryer, with the plurality of air tubes in the retracted configuration and in a folded configuration (FIG. 3). Generally, the plurality of air tubes includes a plurality of air vents 6 positioned thereon, as shown. In the shown embodiment, a central air tube includes two air vents 6 positioned thereon, so as to dry a larger area of an individual's body adjacent to the central air tube. In the shown embodiment, the air tubes of the plurality of air tubes are telescopic and are in the retracted configuration, such that the intermediate portions are nested within the base portions 4, leaving the air vents 6 sitting above the base portion 4. In addition, in the shown embodiment, the air tubes of the plurality of air tubes are pivotally connected to the base portion 4 by pivotal connections 7, which allows the air tubes of the plurality of air tubes to fold inward such that the air tubes are substantially co-planar with the foot pedals (16, 17). In this manner, the full body dryer is configured to be stored underneath a bed or in a closet due to its compactness.

In the shown embodiment, the full body dryer further comprises a plurality of castor wheels 8 disposed on an underside of the semi-circular base 2. The plurality of castor wheels 8 configures the full body dryer to be rolled on a surface, such as a ground or a floor of a room, for example, and may facilitate placement of the full body dryer in a compact space, such as underneath a bed or other structure. In the shown embodiment, one or more ball-detent systems 18, placed at a bottom portion of the base portions 4 (depicted as small circles at the base portions 4) are included so as to enable the individual to lock and unlock the base portions 4, and by extension the air tubes, at one or more particular angle(s) with respect to the semi-circular base 2. In such embodiments, the air tubes may be locked in an upright position (see FIG. 2) in preparation for use, or may be locked in a downward position (see FIG. 3) in preparation for storage or transport of the full body dryer.

Figure 4:
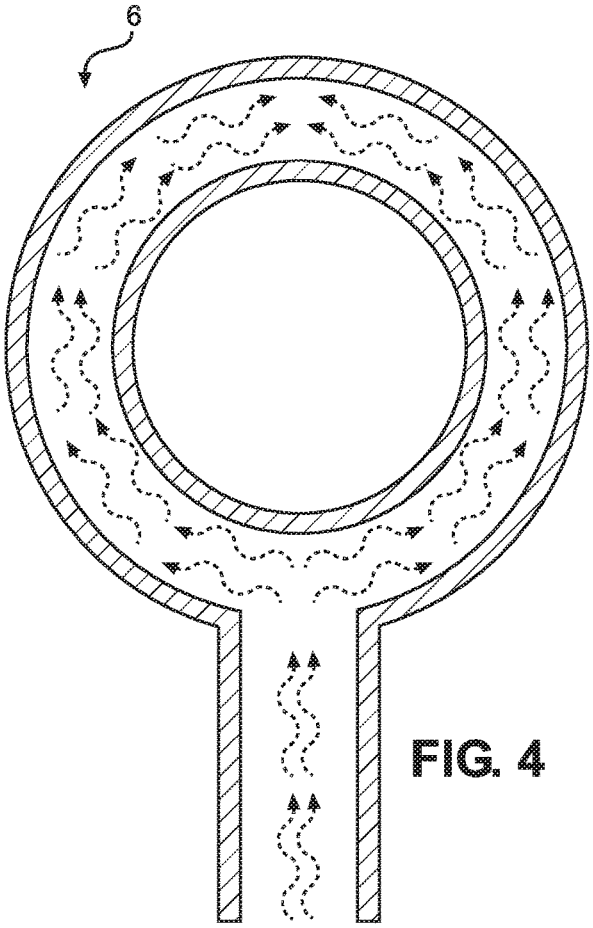
FIG. 4 depicts a cross sectional view of an exemplary air vent positioned atop an air tube of the plurality of air tubes.

Referring now to FIG. 4, there is depicted a cross sectional view of an exemplary air vent positioned atop an air tube of the plurality of air tubes. In the shown embodiment, the air vent 6 includes a circular portion attached to a stem portion. During use, air flows from the air tube thereunder upward and into the stem portion of the air vent 6, where the air flows around a circular center of the air vent 6 and out of the cross sectional view, e.g., toward or away from the viewer of FIG. 4. In this manner, the portion of the air vent 6 that expels air is a circle or has a circular shape.

Figure 5:
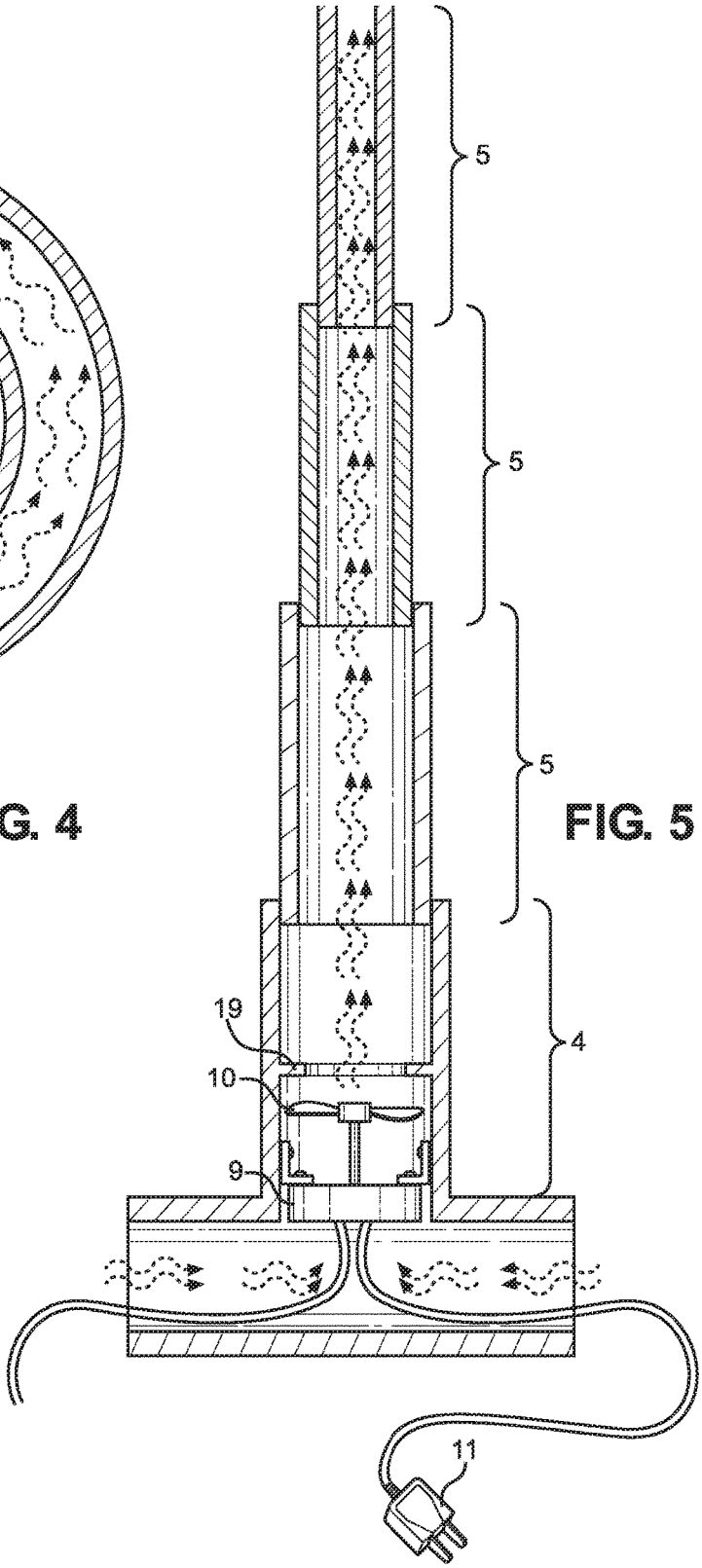
FIG. 5 depicts a cross sectional view of an exemplary air tube of the plurality of air tubes.

Referring now to FIG. 5, there is depicted a cross sectional view of an exemplary air tube of the plurality of air tubes. In the shown embodiment, the air tube is telescopic, and includes a plurality of intermediate portions 5 thereon, configured to nest in a telescopic manner to extend or retract the air tube toward the extended configuration (as shown) or the retracted configuration (as shown in FIG. 3). In some embodiments, the base portion 4 includes an internal structure upon which the plurality of intermediate portions 5 rest when in the retracted configuration. In the shown embodiment, the internal structure includes a lip 19 affixed to an interior surface of a sidewall of the base portion 4, above the fan 10, configured to receive the plurality of intermediate portions 5 thereon and also allow air to pass therethrough toward the air vent above. In this manner, the intermediate portions 5 do not contact or damage the fan 10 or other components inside the base portion 4.

In the shown embodiment, the fan 10 is operably connected to an assembly 9 having a motor and a heating element therein, and upon activation of the motor, the fan 10 rotates to draw air from the semi-circular base thereunder, through the assembly 9, and upward through the air tube above. The semi-circular base is fluidly connected to the base portion 4, which is fluidly connected to each intermediate portion of the plurality of intermediate portions 5, which are fluidly connected to the air vent above for expelling the air. In both FIGS. 4 and 5, dotted arrows represent a movement of air through the device during use or operation. A power cable 11 runs through the semi-circular base portion and to each assembly 9, and in this manner, each assembly 9 receives electricity from a power source, such as a wall outlet that provides alternating current to power the motor and the heating element of the assembly 9.

In the shown embodiment, each air tube of the plurality of air tubes includes the base portion 4 thereunder, and each base portion 4 includes the assembly 9 (with the motor and the heating element therein), the fan 10, and the power cable 11 therein, as shown in the exemplary air tube of FIG. 5. In various embodiments, a first selection of foot pedals of the plurality of foot pedals is operably connected to the motor of the assembly 9 of each base portion 4, and a second selection of foot pedals of the plurality of foot pedals is operably connected to the heating element of the assembly 9 of each base portion 4. In this manner, actuation of the first selection, e.g., the left foot pedal, activates each motor of each assembly 9 of each base portion 4, thereby activating the fan 10 to blow air for use of the full body dryer. In addition, in this manner (e.g., after activation of the fan 10), actuation of the second selection, e.g., the right foot pedal, activates each heating element of each assembly 9 of each base portion 4, thereby heating the air being blown through the assembly by the fan 10 such that the air that reaches the user is warmer than ambient air. In this manner, each air vent may be activated and used in combination with each other air vent.

In alternate embodiments, the plurality of foot pedals includes one or more foot pedals for individually controlling each assembly 9 of each base portion 4. For instance, if only a subset of the air vents is intended for use, the user may activate one or more foot pedals corresponding to the assembly 9 of the base portion 4 of the air vents so desired. In this manner, the user may activate a subset, such as one, two, three, or more, of the air vents for use to dry the user's body or a portion thereof.

Figure 6:
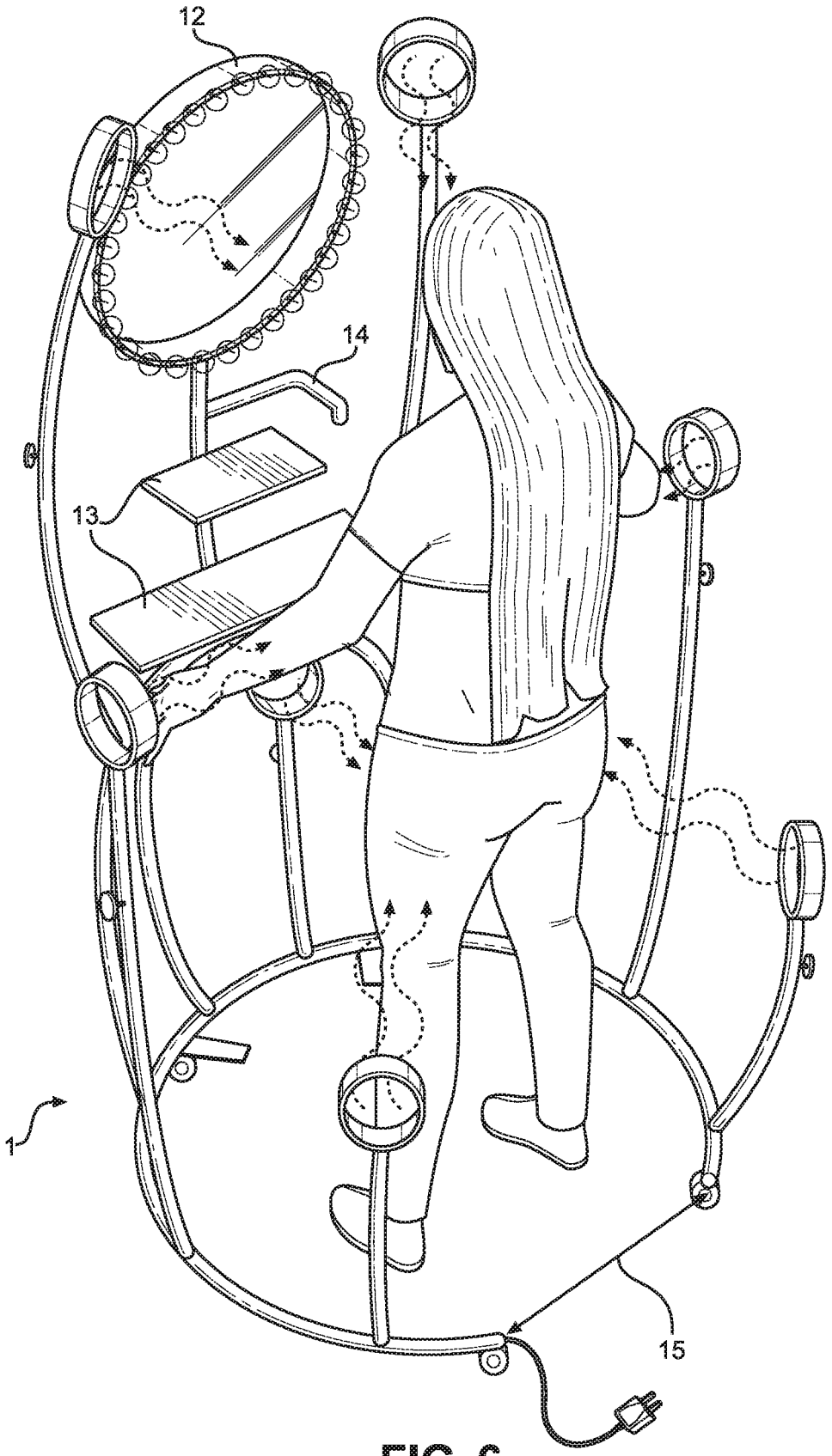
FIG. 6 depicts a perspective view of an exemplary full body dryer with a plurality of air tubes in an extended configuration, during use.

Referring now to FIG. 6, there is depicted a perspective view of an exemplary full body dryer with a plurality of air tubes in an extended configuration, during use. In the shown embodiment, the full body dryer 1 includes one or more accessories attached thereto, such as one or more of a lighted mirror 12, a shelf 13, a hook 14, and a combination thereof. In the shown embodiment, a gap 15 exists between the two ends of the semi-circular base, and the gap 15 is sized or dimensioned to receive a wheelchair therethrough. In this manner, an individual in the wheelchair can access and operate the full body dryer 1.

In the embodiments shown in FIGS. 1-3, there are seven air tubes and eight air vents. In the embodiment shown in FIG. 6, there are eight air tubes and seven air vents. However, it is contemplated that a greater or a lesser number of air tubes and/or air vents may be utilized in a particular implementation. Accordingly, it is envisioned that various embodiments may have any number of air tubes and air vents. In this manner, in certain aspects, the full body dryer 1 is effectively customizable according to a particular design or implementation.

The full body dryer 1 may be configured to be on or off by use of one of the foot pedals, e.g., the left foot pedal, and may be configured to deliver warm or hot air by use of the other foot pedal, e.g., the right foot pedal. In such embodiments, the left foot pedal is operably connected to the motors to control whether the motors are on or off, and the right foot pedal is operably connected to the heating elements to control whether the heating elements are on or off. Thus, it is envisioned that the full body dryer 1 is capable of delivering warm or hot air by use of the heating elements, or delivering cool or cold air by not using the heating elements. In such embodiments, the cool or cold air may include ambient-temperature air from a space around the full body dryer 1. In this manner, the full body dryer 1 may be configured to warm an individual that would otherwise be chilled by a cooling effect of evaporating water after a bathing session, and also may be configured to deliver ambient-temperature air to an individual who enjoys or otherwise benefits from the cooling effect.

In some embodiments the air tubes are telescopic, and in some embodiments the air tubes are not telescopic and may be fixed in a particular configuration. The base portions may be pivotally connected to the semi-circular base for compact storage of the full body dryer, but in other embodiments the base portions may not be pivotally connected to the semi-circular base. Thus, it is envisioned that in some embodiments the full body dryer 1 is retractable for storage or transport, and in others, the full body dryer 1 is not retractable and remains in the extended configuration.

In some embodiments, the full body dryer 1 includes a master foot pedal that controls whether power is supplied to the motors, and also includes a separate foot pedal for each motor that controls whether that particular motor is turned on. In various embodiments, the semi-circular base is hollow, and includes an opening on a portion thereof, such as an inner face thereof, through which air may be transported from an exterior of the full body dryer 1 to the air tubes by way of a pulling force of the fans operably connected to the motors. In this manner, the fans do not create a vacuum during operation, and the flow of air through the fully body dryer 1 is not hindered.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the present invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A full body dryer, comprising:

a semi-circular base with a plurality of air tubes extending arcuately upward therefrom;

wherein each air tube of the plurality of air tubes includes a base portion on a lower end thereof, wherein each base portion is connected to the semi-circular base;

wherein each base portion includes a motor, a fan, and a heating element therein, wherein the motor is operably connected to the fan, and wherein the motor and the heating element are operably connected to a power source.

2. The full body dryer of claim 1, wherein each air tube of the plurality of air tubes includes an air vent on an upper portion thereof, wherein each interior of each air vent is fluidly connected to an interior of the air tube thereunder.

3. The full body dryer of claim 1, wherein the semi-circular base includes a gap dimensioned to receive a wheelchair therethrough.

4. The full body dryer of claim 1, further comprising one or more accessories attached thereto, wherein the one or more accessories includes one or more accessories selected from a group consisting of: a lighted mirror, a shelf, a hook, and a combination thereof.

5. The full body dryer of claim 1, further comprising a plurality of castor wheels disposed on an underside of the semi-circular base, wherein the plurality of castor wheels configures the full body dryer to be rolled on a surface.

6. A full body dryer, comprising:

a semi-circular base with a plurality of telescopic air tubes extending arcuately upward therefrom;

wherein each air tube of the plurality of air tubes includes a base portion on a lower end thereof, wherein each base portion is pivotally connected to the semi-circular base;

wherein each base portion includes a motor, a fan, and a heating element therein, wherein the motor is operably connected to the fan, and wherein the motor and the heating element are operably connected to a power source.

7. The full body dryer of claim 6, wherein each air tube of the plurality of air tubes includes an air vent on an upper portion thereof, wherein each interior of each air vent is fluidly connected to an interior of the air tube thereunder.

8. The full body dryer of claim 6, wherein the semi-circular base includes a gap dimensioned to receive a wheelchair therethrough.

9. The full body dryer of claim 6, further comprising one or more accessories attached thereto, wherein the one or more accessories includes one or more accessories selected from a group consisting of: a lighted mirror, a shelf, a hook, and a combination thereof.

10. The full body dryer of claim 6, further comprising a plurality of castor wheels disposed on an underside of the semi-circular base, wherein the plurality of castor wheels configures the full body dryer to be rolled on a surface.

11. A full body dryer, comprising:

a semi-circular base with a plurality of telescopic air tubes extending arcuately upward therefrom and a plurality of foot pedals extending laterally therefrom;

wherein each air tube of the plurality of air tubes includes a base portion on a lower end thereof, wherein each base portion is pivotally connected to the semi-circular base;

wherein each base portion includes a motor, a fan, and a heating element therein, wherein the motor is operably connected to the fan, and wherein the motor and the heating element are operably connected to a power source;

wherein a first selection of foot pedals of the plurality of foot pedals is operably connected to the motor, and wherein a second selection of foot pedals of the plurality of foot pedals is operably connected to the heating element.

12. The full body dryer of claim 11, wherein each air tube of the plurality of air tubes includes an air vent on an upper portion thereof, wherein each interior of each air vent is fluidly connected to an interior of the air tube thereunder.

13. The full body dryer of claim 11, wherein the semi-circular base includes a gap dimensioned to receive a wheelchair therethrough.

14. The full body dryer of claim 11, further comprising one or more accessories attached thereto, wherein the one or more accessories includes one or more accessories selected from a group consisting of: a lighted mirror, a shelf, a hook, and a combination thereof.

15. The full body dryer of claim 11, further comprising a plurality of castor wheels disposed on an underside of the semi-circular base, wherein the plurality of castor wheels configures the full body dryer to be rolled on a surface.

* * * * *